US007427099B1

(12) United States Patent
Lin et al.

(10) Patent No.: US 7,427,099 B1
(45) Date of Patent: Sep. 23, 2008

(54) SAFETY DEVICE FOR FOLDING CHAIR

(76) Inventors: Mei Chuen Lin, 9F, No. 275-1, Yuan-Hua Road, Chung-Li City, Taoyuan Hsien (TW); Tzu Mei Wang, 9F, No. 275-1, Yuan-Hua Road, Chung-Li City, Taoyuan Hsien (TW)

( * ) Notice: Subject to any disclaimer, the term of this patent is extended or adjusted under 35 U.S.C. 154(b) by 0 days.

(21) Appl. No.: 11/871,322

(22) Filed: Oct. 12, 2007

(51) Int. Cl.
*A47C 4/00* (2006.01)

(52) U.S. Cl. ..... 297/56

(58) Field of Classification Search ..... 297/55, 297/16.1, 463.1, 56
See application file for complete search history.

(56) References Cited

U.S. PATENT DOCUMENTS 3,319,997 A * 5/1967 Clement ..... 297/16.1
6,056,354 A * 5/2000 Tseng ..... 297/56
6,305,742 B1 * 10/2001 Spendlove et al. ..... 297/16.1
7,338,116 B1 * 3/2008 Lin et al. ..... 297/46

* cited by examiner

*Primary Examiner*—Milton Nelson, Jr.
(74) *Attorney, Agent, or Firm*—Rabin & Berdo, P.C.

(57) ABSTRACT

A safety device for a folding chair includes a base, a handling piece, a pair of casings and a retaining piece. The retaining piece having a retaining hole is mounted on a bottom of a seat. The handling piece is pivotally connected inside the base, and the casing encloses the base and one of rear legs. The handling piece has a hook and a pressing portion at an upper end and a lower end respectively. When the seat is pressed down, the retaining piece glides between the hook and the rear leg. Then, the hook is engaged with the retaining hole. Therefore, the chair is locked in an open position and children's safety is ensured. When lifting the seat, the pressing portion is pressed to disengage the hook from the retaining piece. The chair is folded to a closed position.

4 Claims, 5 Drawing Sheets

SAFETY DEVICE FOR FOLDING CHAIR

BACKGROUND OF THE INVENTION

1. Field of the Invention

The present invention relates to a safety device for a folding chair, and in particular to a safety device for a folding chair to keep the chair in an open position.

2. The Prior Arts

A conventional folding chair comprises a seat, a backrest, and front legs and rear legs for folding and unfolding the chair. For convenience of a user, a certain folding chair further includes a spring disposed between the front leg and a frame of the seat. When the user unfolds and sits on the chair, the spring is stretched. When the user leaves the chair, the spring resumes to its original state and automatically folds the chair to a closed position.

The automatic folding chair provides convenience. However, small children are too thin and their weight is not heavy enough to counterbalance the elastic force of the spring. Therefore, small children are often unable to keep the seat at a fully open position, which allows the folding chair to collapse or fold unexpectedly. It results in the children's slipping into the space between the seat and the backrest. This is a serious safety issue to be resolved.

SUMMARY OF THE INVENTION

A primary objective of the present invention is to provide a safety device for a folding chair, which eliminates a drawback of a conventional folding chair that is incapable of keeping the chair in an open position and is likely to allow small children to fall into the space between a seat and a backrest.

In order to prevent the seat of the folding chair from being unexpectedly lifted, a safety device for a folding chair according to the present invention is provided between a seat and a rear leg. The safety device includes a retaining piece, a base, and a handling piece. The retaining piece is disposed vertically under the seat and provided with a retaining hole. The base includes a receiving groove and the handling piece is pivotally connected inside the receiving groove. The handling piece has a hook and a pressing portion at an upper end and a lower end thereof, respectively. The hook and the pressing portion can rotate about a pivot.

A spring is mounted between the seat and one of the front legs. When no one sits on the chair, elastic force of the spring folds the chair to a closed position. If an adult sits on the chair, the weight of the adult is greater than the elastic force of the spring. The seat is unfolded to an open position. If a child is going to sit on the chair, the weight of the child is not heavy enough to unfold the seat to the fully open position. The seat can be pressed down to an open position by hand. When the seat is unfolded to the open position, the retaining piece slides between the rear leg and the handling piece. The hook of the handling piece engages with the retaining hole of the retaining piece, thereby locking the seat at the open position. When the user leaves the chair, the user just needs to press the pressing portion of the handling piece to disengage the hook from the retaining hole. The seat will be lifted to the closed position by the elastic force of the spring.

The safety device for the folding chair according to the present invention can keep the seat at the open position and prevent the seat from accidentally folded to the closed position, when the chair is in use. The safety device prevents the seat from being accidentally lifted, which can result in small children slipping into and being caught in the space between the seat and the backrest.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
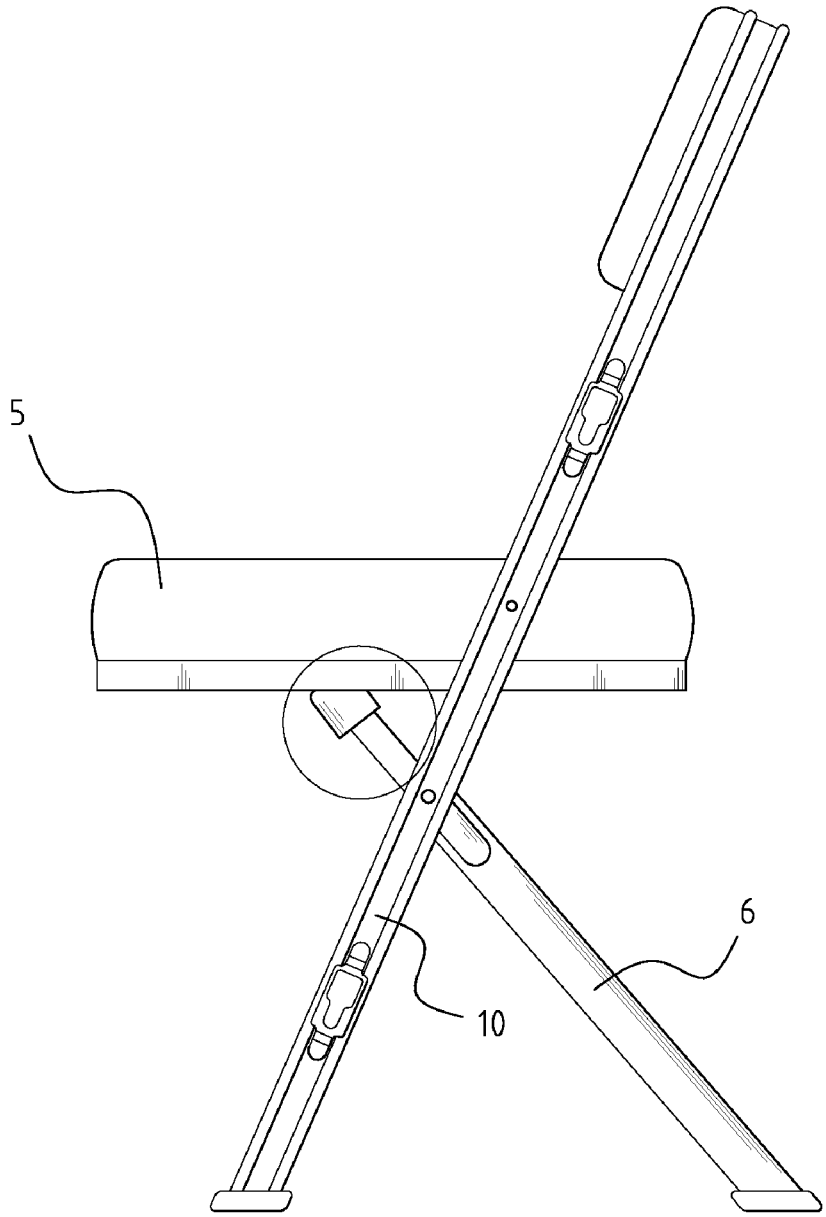
FIG. 1A is a side view showing a folding chair having a safety device according to the present invention, which locks a seat and one of rear legs together.
Figure 1B:
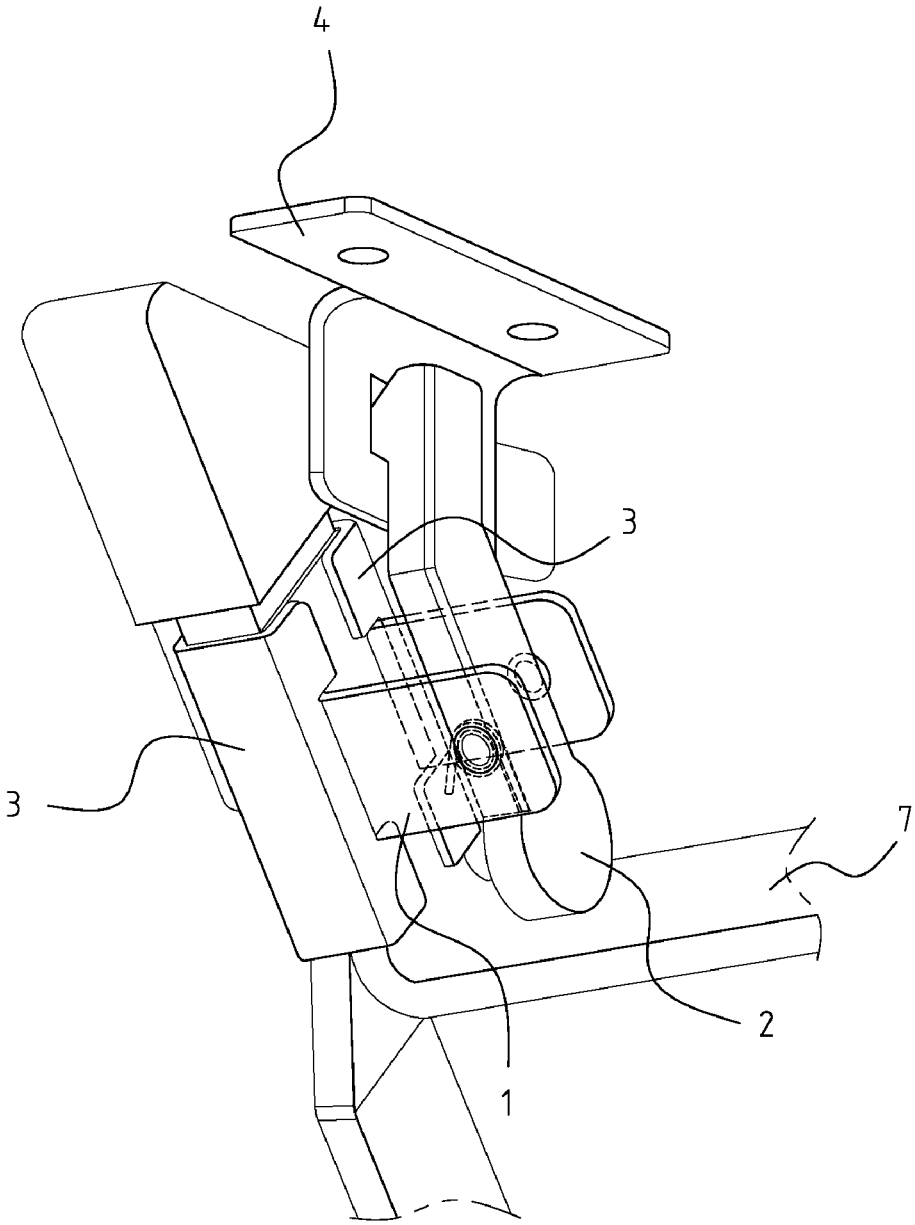
FIG. 1B is a perspective view showing the safety device for the folding chair according to the present invention.

Referring to FIG. 1A, a safety device for a folding chair in accordance with the present invention is disposed between a seat and one of rear legs (the circle in FIG. 1A). Referring to FIG. 1B, the safety device includes a base 1, a handling piece 2, a pair of casings 3, and a retaining piece 4.

Figure 2:
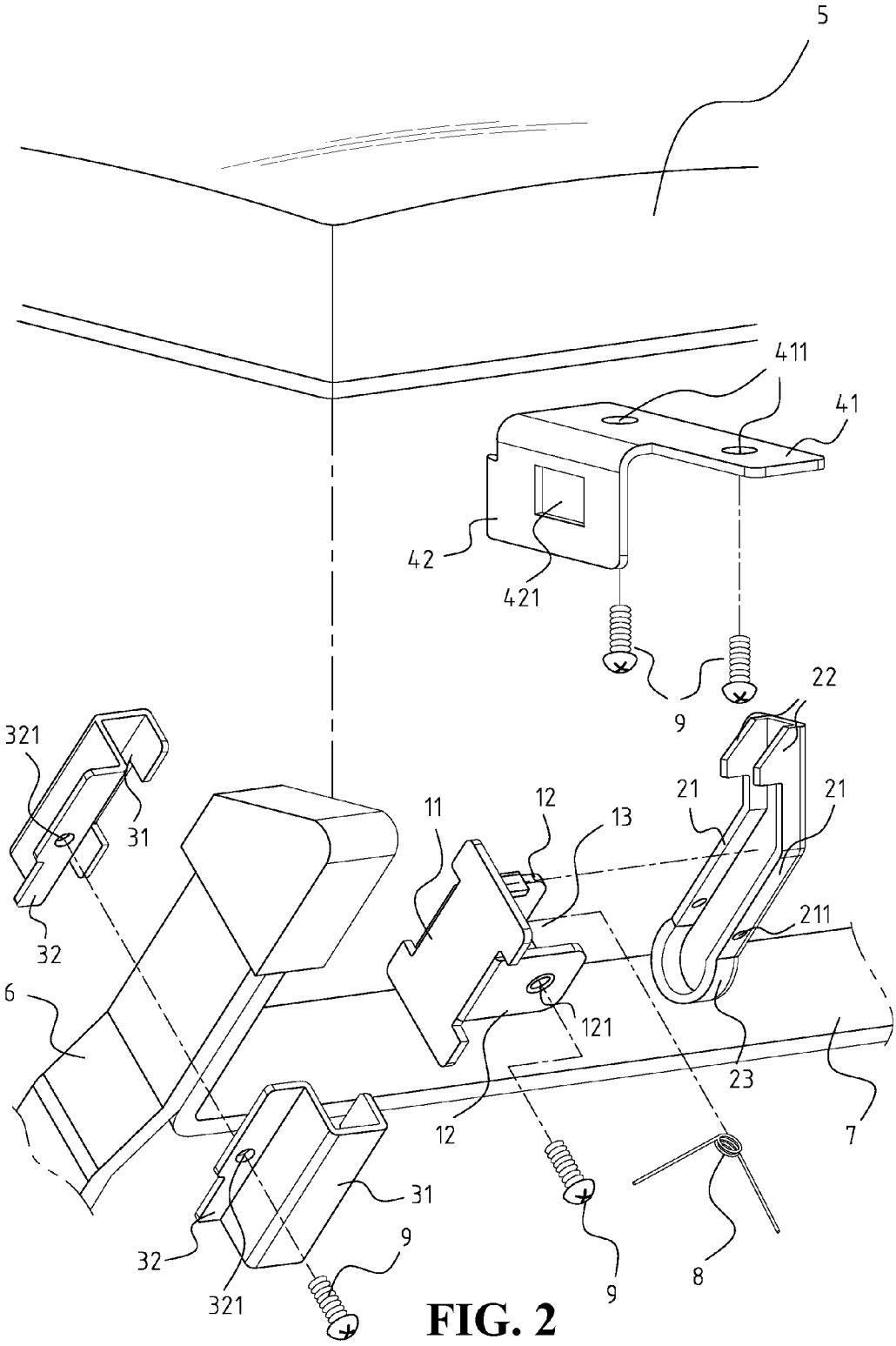
FIG. 2 is an exploded view showing the safety device for the folding chair according to the present invention.

Referring to FIGS. 1B and 2, the base 1 is an integrally formed metal piece. The base 1 includes an I-shaped fixing plate 11 and two symmetric side walls 12 perpendicular to the fixing plate 11. Each side wall 12 comprises a fixing hole 121. A receiving groove 13 is formed between the fixing plate 11 and the side walls 12. The handling piece 2 is an integrally formed U-shaped metal piece. The handling piece 2 comprises two symmetric edge walls 21 and each edge wall 21 has a pivot hole 211. The handling piece 2 includes a hook 22 having a slanted top at one end thereof and a circular pressing portion 23 at the other end thereof. The casing 3 is an integrally formed ladle-shaped metal piece. The casing 3 comprises an enclosing portion 31 and a fixing portion 32 having a fixing hole 321. The retaining piece 4 is an integrally formed L-shaped piece. The L-shaped retaining piece 4 includes a first section 41 and a second section 42 perpendicular to the first section 41. The first section 41 has a plurality of fixing holes 411 and the second section 42 has a retaining hole 421 corresponding to the hook 22.

When assembling the safety device for the folding chair, first of all, the handling piece 2 is disposed in the receiving groove 13 of the base 1. A torsion spring 8 is disposed between the base 1 and the handling piece 2, and arms of the torsion spring 8 are compressed between the base 1 and the handling piece 2. A screw 9 passes through the fixing holes 121 of the base 1, the pivot holes 211 of the handling piece 2, and the torsion spring 8, thereby pivotally connecting the handling piece 2 with the base 1. Thus, the handling piece 2 can rotate about the pivot holes 211 and the screw 9. A U-shaped horizontal bar 7 is mounted between the two rear legs 6. The fixing plate 11 of the base 1 is mounted on a bended portion of the horizontal bar 7 as shown in FIG. 1B. The fixing plate 11 is indirectly connected with the rear leg 6 through the horizontal bar 7. The two casings 3 clip and enclose from both sides of the rear leg 6, the horizontal bar 7 and the fixing plate 11, respectively. A screw 9 passes through the fixing holes 321 on the fixing portions 32 of the casings 3. Therefore, the casings 3 securely fix the base 1 and the rear leg 6 together. Then, the first section 41 of the retaining piece 4 is attached to a bottom of the seat 5, with screws 9 or rivets passing through the fixing holes 411, thereby connecting the retaining piece 4 to the seat 5. The second section 42 of the retaining piece 4 is perpendicular to the seat 5 as shown in FIG. 3.

Figure 3:
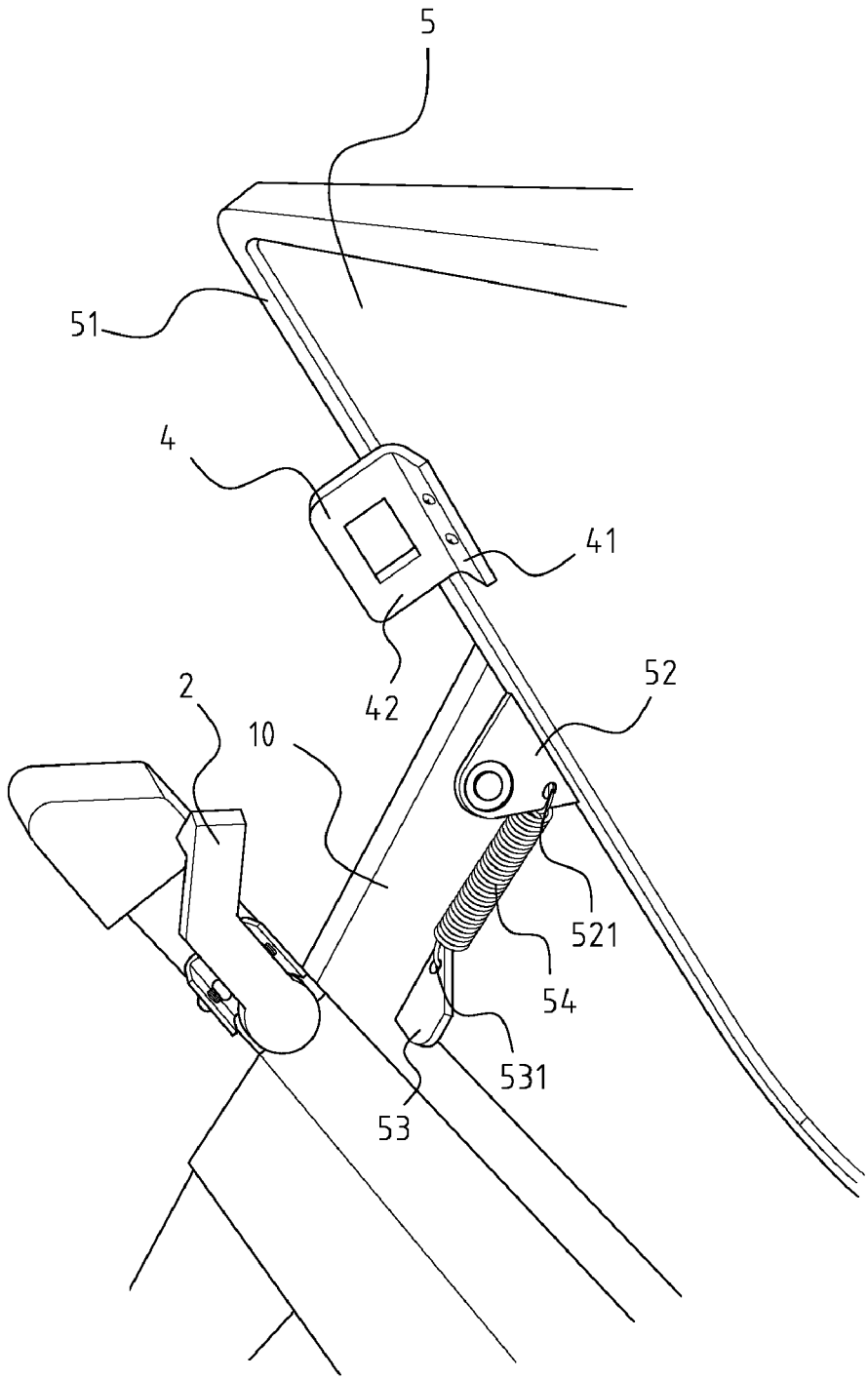
FIG. 3 is a schematic view showing the safety device for the folding chair in an unlocked state.
Figure 4:
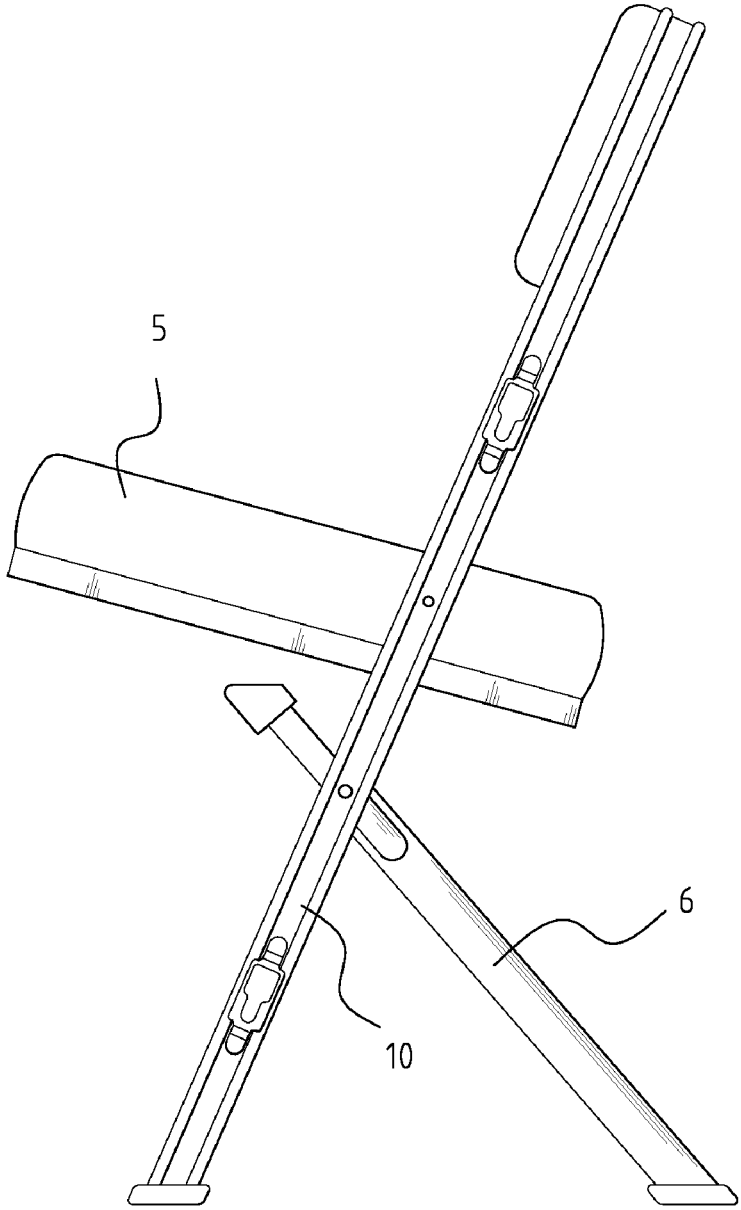
FIG. 4 is a side view showing the safety device for the folding chair in the unlocked state.

Referring to FIG. 3, the seat 5 is lifted to the closed position and the safety device is in an unlocked state. A pivot portion 52 mounted on a seat frame 51 of the seat 5 pivotally connects the seat 5 with the front leg 10 and includes a hole 521. An extension board 53 is disposed below the pivot portion 52 and is mounted to the front leg 10. The extension board 53 has a hole 531. Both ends of a spring 54 are engaged with the holes 521 and 531 respectively. Referring to FIGS. 1B, 3, and 4, when the seat 5 is pressed down, a lower edge of the retaining piece 4 will be contacted with the slanted top of the hook 22. At the mean time, the spring 54 is stretched. The retaining piece 4 glides along the top of the hook 22 of the handling piece 2. Then, the retaining pieces 4 glides into a space between the handling piece 2 and the rear leg 6. The retaining piece 4 forces the handling piece 2 to rotates about pivot holes 211, and the hook 22 moves away from the rear leg 6. Then, the hook 22 of the handling piece 2 is forced into the retaining hole 421 of the retaining piece 4, thereby locking the handling piece 2 and the retaining piece 4 together. When the hook 22 rotates away from the rear leg 6, arms of the torsion spring 8 are compressed between the fixing plate 11 of the base 1 and the handling piece 2. After the hook 22 is engaged with the retaining hole 421, the torsion spring 8 resumes to its original state, thereby counter rotating the handling piece 2 back to its original state. Therefore, the seat 5 is securely connected with the rear leg 6. When the user is going to lift the seat 5, the pressing portion 23 of the handling piece 2 is pressed. The hook 22 rotates away from the base 1 and disengages from the retaining hole 421 of the retaining piece 4. The stretched spring 54 resumes to an un-stretched state and elastic force of the spring 54 lifts the seat 5 to the closed position. The safety device is not limited to one set. The folding chair may include two safety devices at both sides of the chair, respectively.

The advantage of the safety device for the folding chair according to the present invention is that the safety device can be activated by body weight. When the user sits on the seat 5, the body weight makes the retaining piece 4 slide along the slanted top of the hook 22 and the hook 22 is forced to engage with the retaining hole 421 of the retaining piece 4. Thus, the seat 5 is connected with the rear leg 6 and the folding chair is kept at the open position. If a small child or a thin user is going to sit on the chair, the body weight is not heavy enough to unfold the chair to the fully open position. He or she can press down the seat 5 to engage the retaining piece 4 with the handling piece 2 by hand. The safety device keeps the seat 5 in the open position and prevents the seats 5 from being accidentally lifted. Because the body weight of the child is light, the seat of a conventional folding chair is likely to partially tilt. Thus, the child is likely to slide into and be caught in the space between the backrest and the seat. The safety device can prevent this hazard. When trying to unfold the folding chair, it only needs to press the pressing portion 23 of the handling piece 2. The elastic force of the spring 54 will lift the seat 5 and fold the chair.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A safety device for a folding chair, the safety device being mountable on a bottom of a seat and one of a plurality of rear legs, and comprising:

a base comprising a fixing plate mountable on an inner side of the rear leg, two side walls perpendicular to the fixing plate, and a receiving groove formed between the fixing plate and the side walls;

a handling piece disposed inside of the receiving groove, pivotally connected with the side walls, and comprising a hook and a pressing portion, and being rotatable about pivot points where the handling piece is pivotally connected with the side walls;

a pair of casings, each casing comprising an enclosing portion and a fixing portion, with the two enclosing portions for enclosing both sides of the rear leg and the fixing plate of the base, and the fixing portions of the casings being fixed together; and a retaining piece mountable on the bottom of the seat, and comprising a retaining hole to engage with the hook of the handling piece, thereby securely connecting the seat with the rear leg.

2. The safety device as claimed in claim 1, wherein when the pressing portion is pressed, the hook of the handling piece is rotatable to be disengaged from the retaining hole of the retaining piece, the safety device further comprising:

a torsion spring disposed between the handling piece and the fixing plate of the base; and a screw passing through the side walls, the torsion spring and the handling piece, thereby pivotally connecting the handling piece with the base.

3. The safety device as claimed in claim 1, wherein the retaining piece is L-shaped and comprises a first section mountable on the bottom of the seat, and a second section perpendicular to the first section and having the retaining hole.

4. The safety device as claimed in claim 1, wherein each casing is ladle-shaped and comprises a fixing hole at the fixing portion, so that the pair of the casings are capable of being fixed together.

* * * * *